US006624586B2

(12) United States Patent
Abe et al.

(10) Patent No.: US 6,624,586 B2
(45) Date of Patent: Sep. 23, 2003

(54) ELECTRON SOURCE AND IMAGE FORMING APPARATUS

(75) Inventors: Naoto Abe, Kanagawa (JP); Mitsutoshi Hasegawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/726,024

(22) Filed: Nov. 30, 2000

(65) Prior Publication Data

US 2001/0017526 A1 Aug. 30, 2001

Related U.S. Application Data

(63) Continuation of application No. PCT/JP00/02172, filed on Apr. 4, 2000.

(30) Foreign Application Priority Data

Apr. 5, 1999 (JP) ..... 11-097853

(51) Int. Cl.[7] ..... H01J 9/39

(52) U.S. Cl. ..... 315/169.1; 315/169.3; 313/497

(58) Field of Search ..... 315/169.3, 169.1, 315/169.2; 313/495, 496, 497

(56) References Cited

U.S. PATENT DOCUMENTS

| | | | | |
|---|---|---|---|---|
| 4,904,895 A | | 2/1990 | Tsukamoto et al. | 313/336 |
| 5,066,883 A | | 11/1991 | Yoshioka et al. | 313/309 |
| 5,223,766 A | | 6/1993 | Nakayama et al. | 313/495 |
| 5,300,862 A | | 4/1994 | Parker et al. | 315/169.1 |
| 5,569,974 A | | 10/1996 | Morikawa et al. | 313/310 |
| 5,682,085 A | | 10/1997 | Suzuki et al. | 315/169.1 |
| 5,931,713 A | * | 8/1999 | Watkins et al. | 445/55 |
| 5,936,342 A | | 8/1999 | Ono et al. | 313/495 |
| 5,939,342 A | | 8/1999 | Ono et al. | 313/495 |
| 6,278,234 B1 | * | 8/2001 | Ono et al. | 313/495 |

FOREIGN PATENT DOCUMENTS

| | | |
|---|---|---|
| EP | 0 688 035 A1 | 12/1995 |
| EP | 0 717 429 A1 | 6/1996 |
| EP | 0762371 A2 | 3/1997 |
| EP | 0762372 A2 | 3/1997 |
| EP | 0798691 A1 | 10/1997 |
| JP | 64-31332 | 2/1989 |
| JP | 2-257551 | 10/1990 |
| JP | 3-55738 | 3/1991 |
| JP | 4-12436 | 1/1992 |
| JP | 4-28137 | 1/1992 |
| JP | 9-82245 | 3/1999 |

OTHER PUBLICATIONS

M.I. Elinson, Radio Engineering Electron Physics, 10, 1290 (1965); The Emission of Hot Electrons and the Field Emission of Electrons from Tin Oxide.

G. Dittmer, Thin Solid Films, 9, 317 (1972); Electrical Conduction and Electron Emission of Discontinuous Thin Films.

(List continued on next page.)

*Primary Examiner*—David H. Vu

(74) *Attorney, Agent, or Firm*—Fitzpatrick, Cella, Harper & Scinto

(57) ABSTRACT

An electron source apparatus is provided that is capable of suppressing variations in electron emission state from electron-emitting devices due to changes over time in getters, or spacers, along with an image forming apparatus that uses the electron source apparatus. A plurality of row-direction and column-direction wiring lines are formed on a substrate so as to cross each other. An electron-emitting device made up of device electrodes, a conductive film, and an electron-emitting portion is formed at each intersection between the wiring lines. The getters are arranged on at least some of the row-direction wiring lines, which are connected to a voltage application means that includes a voltage source and a switching circuit for selecting the row-direction wiring lines, and the column-direction wiring lines are connected to controlled current sources capable of outputting desired current values in accordance with the changes in the getters.

6 Claims, 13 Drawing Sheets

OTHER PUBLICATIONS

M. Hartwell, IEEE Transactions Electron Devices Conference, 519 (1975); Strong Electron Emission from Patterned Tin–Indium Oxide Thin Films.

H. Araki, Journal of the Vacuum Society of Japan, vol. 26, No. 1, p. 22 (1983); Electroforming and Electron Emission of Carbon Thin Films.

W.P. Dyke, Advances in Electronics and Electron Physics, 8, 89 (1956); Field Emission.

C.A. Spindt, Journal of Applied Physics, 47, 5248 (1976); Physical properties of thin–film field emission cathodes with molybdenum cones.

C.A. Mead, Journal of Applied Physics, 32, 646 (1961); Operation of Tunnel–Emission Devices.

R. Meyer, Technical Digest of 4th International Vacuum Microelectronics Conference, Recent Development on Microtips Display at Leti, Nagahama, pp. 6–9 (1991).

* cited by examiner

ELECTRON SOURCE AND IMAGE FORMING APPARATUS

This application is a continuation of International Application No. PCT/JP00/02172, filed Apr. 4, 2000, which claims the benefit of Japanese Patent Application No. 11-097853, filed Apr. 5, 1999.

TECHNICAL FIELD

The present invention relates to an electron source apparatus having a plurality of electron-emitting devices wired in a matrix, and an image forming apparatus using the electron source apparatus.

BACKGROUND ART

Conventionally, two types of devices, namely thermionic and cold cathode devices, are known as electron-emitting devices. Known examples of the cold cathode devices are field emission type electron-emitting devices (to be referred to as FE type electron-emitting devices hereinafter), and metal/insulator/metal type electron-emitting devices (to be referred to as MIM type electron-emitting devices hereinafter). A known example of surface-conduction emission type electron-emitting devices is described in, e.g., M. I. Elinson, "Radio Eng. Electron Phys., 10, 1290 (1965) and other examples will be described later.

The surface-conduction emission type electron-emitting device utilizes the phenomenon that electrons are emitted by a small-area thin film formed on a substrate by flowing a current in parallel with the film surface. The surface-conduction emission type electron-emitting device includes electron-emitting devices using an Au thin film [G. Dittmer, "Thin Solid Films", 9, 317 (1972)], an $In_2O_3/SnO_2$ thin film[ M. Hartwell and C. G. Fonstad, "IEEE Trans. ED Conf.", 519 (1975)] , a carbon thin film [Hisashi Araki et al., "Vacuum", Vol. 26, No. 1, p. 22 (1983)], and the like, in addition to an $SnO_2$ thin film according to Elinson mentioned above.

Known examples of the FE type electron-emitting devices are described in W. P. Dyke and W. W. Dolan, "Field emission", Advance in Electron Physics, 8, 89 (1956) and C. A. Spindt, "Physical properties of thin-film field emission cathodes with molybdenium cones", J. Appl. Phys., 47, 5248 (1976).

As another FE type device structure, there is an example in which an emitter and gate electrode are arranged on a substrate to be almost parallel to the surface of the substrate.

A known example of the MIM type electron-emitting devices is described in C. A. Mead, "Operation of tunnel emission Devices", J. Appl. Phys., 32,646 (1961).

Since the above-described cold cathode devices can emit electrons at a temperature lower than that for thermionic cathode devices, they do not require any heater. The cold cathode device has a structure simpler than that of the thermionic cathode device and can shrink in feature size. Even if a large number of devices are arranged on a substrate at a high density, problems such as heat fusion of the substrate hardly arise. In addition, the response speed of the cold cathode device is high, while the response speed of the thermionic cathode device is low because thermionic cathode device operates upon heating by a heater.

For this reason, applications of the cold cathode devices have enthusiastically been studied.

Of cold cathode devices, the surface-conduction emission type electron-emitting devices have a simple structure and can be easily manufactured, so that many devices can be formed on a wide area. As disclosed in Japanese Patent Laid-Open No. 64-31332 filed by the present applicant, a method of arranging and driving many devices has been studied.

Regarding applications of the surface-conduction emission type electron-emitting devices, e.g., image forming apparatuses such as an image display apparatus and image recording apparatus, charge beam sources, and the like have been studied.

Particularly as an application to image display apparatuses, as disclosed in the U.S. Pat. No. 5,066,883 and Japanese Patent Laid-Open Nos. 2-257551 and 4-28137 filed by the present applicant, an image display apparatus using a combination of a surface-conduction emission type electron-emitting device and a fluorescent substance which emits light upon irradiation with an electron beam has been studied. This type of image display apparatus using a combination of the surface-conduction emission type electron-emitting device and fluorescent substance is expected to exhibit more excellent characteristics than other conventional image display apparatuses. For example, compared to recent popular liquid crystal display apparatuses, the above display apparatus is superior in that it does not require any backlight because of self-emission type and that it has a wide view angle.

A method of driving a plurality of FE type electron-emitting devices arranged side by side is disclosed in, e.g., U.S. Pat. No. 4,904,895 filed by the present applicant. A known application of FE type electron-emitting devices to an image display apparatus is a flat panel display apparatus reported by R. Meyer et al. [R. Meyer: "Recent Development on Microtips Display at LETI", Tech. Digest of 4th Int. Vacuum Microelectronics Conf., Nagahara, pp. 6–9 (1991)]. An application of many MIM type electron-emitting devices arranged side by side to an image display apparatus is disclosed in Japanese Patent Laid-Open No. 3-55738 filed by the present applicant.

FIG. 1 shows an example of a multi electron source wiring method. In the electron source shown in FIG. 1, m cold cathode devices in the vertical direction and n cold cathode devices in the horizontal direction, i.e., a total of n×m cold cathode devices are two-dimensionally arrayed in a matrix. In FIG. 1, reference numeral 3074 denotes a cold cathode device; 3072, a row-direction wiring line; 3073, a column-direction wiring line; 3075, a wiring resistance of the row-direction wiring line; and 3076, a wiring resistance of the column-direction wiring line. Reference symbols Dx1, Dx2, . . . , Dxm denote feeding terminals of the row-direction wiring lines; and Dy1, Dy2, . . . , Dyn, feeding terminals of the column-direction wiring lines. This simple wiring method is called a matrix wiring method. The matrix wiring method can easily manufacture a multi electron source because of a simple structure.

When a multi electron beam by the matrix wiring method is to be applied to an image forming apparatus, m and n must be several hundreds or more in order to ensure the display capacitance. Further, a cold cathode device must accurately output an electron beam with a desired intensity in order to display an image at an accurate luminance.

When many cold cathode devices wired in a matrix are to be driven, devices of one row of the matrix are simultaneously driven. The row to be driven is sequentially switched to scan all the rows. According to this method, the driving time assigned each device is ensured n times longer than in a method of sequentially scanning all the devices one by one. Thus, the luminance of the display apparatus can be increased.

More specifically, there are proposed an arrangement in which a voltage source is connected to matrix wiring to drive devices, and a method of driving FE type devices using a controlled constant current source, as disclosed in U.S. Pat. No. 5,300,862 to Parker et al. FIG. 2 is a circuit diagram for explaining this.

In U.S. Pat. No. 5,300,862, the X direction shown in FIG. 2 is a row direction, and the Y direction is a column direction. In the following description, however, the X direction is defined as a column direction, and the Y direction is defined as a row direction in order to match the description of the present invention.

In FIG. 2, reference numerals 2201*a*, 2201*b*, and 2201*c* denote controlled constant current sources; 2202, a switching circuit; 2203, a voltage source; 2204*a*, column wiring lines; 2204*b*, row wiring lines; and 2205, FE type devices.

The switching circuit 2202 selects one of the row wiring lines 2204*b*, and connects it to the voltage source 2203. The controlled constant current sources 2201*a*, 2201*b*, and 2201*c* supply currents to the respective column wiring lines 2204*a*. These operations are properly performed in synchronism with each other to drive FE type devices of one row.

Arrangements in which an electron source having surface-conduction emission type electron-emitting devices is driven using a constant current source are disclosed in European Patent Laid-Open EP688035A, EP762371A, EP762372A, and EP798691A.

The characteristics of the cold cathode electron-emitting device described above are influenced more or less by an atmosphere (vacuum degree or the quality of vacuum) in which the device is arranged. When the electron-emitting device is driven, various gases are discharged by the device itself and a member irradiated with an electron beam emitted by the device. If such gas is discharged, it influences not only the characteristics of each device but also the characteristics of an adjacent device in an electron source or image forming apparatus in which many electron-emitting devices must be arrayed at a high density. To prevent this, important is how to keep high vacuum in the atmosphere where electron-emitting devices are arranged in the electron source or image forming apparatus in which electron-emitting devices are arrayed at a high density.

As a solution, a getter for exhausting a gas is considered to be arranged near each electron-emitting device. There are proposed an arrangement (see Japanese Patent Laid-Open No. 9-82245) in which the getter is arranged on a wiring line for driving each electron-emitting device, and an arrangement (see Japanese Patent Laid-Open No. 4-12436) in which the wiring line itself is formed from the getter.

DISCLOSURE OF INVENTION

An atmosphere around each electron-emitting device can be kept high vacuum by arranging a getter. In particular, it is preferable that the getter be directly arranged on the wiring line, or the wiring line itself be formed from the getter, as described above.

The getter exhausts a gas present around it by chemically or physically adsorbing the gas present in the atmosphere to its surface. As the getter exhausts a larger amount of gas present in the atmosphere, the composition of the getter itself changes over time. From this, the inventor of the present application has found that changes in getter itself over time lead to changes in the resistance of an electrical path extending from a driving circuit to an electron-emitting device in an arrangement in which the getter material is electrically connected to a wiring line such that the getter is arranged on the wiring line or the wiring line itself is formed from the getter material, as described above.

The degree of changes in the composition of the getter itself changes depending on a position where the getter is arranged or the driving state of an adjacent electron-emitting device. The inventor of the present application has found that even if a desired state is ensured in the initial stage such that the resistance values of electrical paths extending from the driving circuit to respective electron-emitting devices are uniform, the resistances of the electrical paths vary with the lapse of time.

According to the finding of the inventor of the present application, the influence of changes in getter over time typically appears when the getter is arranged on a row-direction wiring line in an arrangement which has electron-emitting devices arranged in a matrix, and sequentially scans row-direction wiring lines to line-sequentially drive the devices. In addition, the influence especially typically appears when the getter is arranged on a row-direction wiring line in an arrangement using an electron-emitting device in which a current flowing into the electron-emitting device is equal to or larger than an emitted current. The influence typically appears when the getter is electrically connected to a wiring line such that the getter is in contact with the wiring line, and particularly typically appears when the wiring line is a row-direction wiring line as a scanning wiring line, or when the electron-emitting device is an electron-emitting device in which a current flowing into the electron-emitting device is equal to or larger than an emitted current.

From these results, the inventor of the present application has found that if the electron-emitting device is driven in accordance with electron emission characteristics and/or the resistance of the electrical path in the initial state, uniformity of the electron emission characteristics of the electron source may degrade, or variations in the luminance of the display or color misregistration may occur.

The inventor of the present application has found the influence of the getter on the electrical path extending from the driving circuit to the electron-emitting device, and has found as a result of extensive studies an arrangement capable of suitably driving the electron-emitting device even with an arrangement suffering this influence.

More specifically, an invention according to the present application can implement an electron source and image forming apparatus which have long service lives, almost no characteristic variations, and high uniformity.

One invention of an electron source according to the present application has the following arrangement.

An electron source comprises:

an electron source substrate which has on a substrate a plurality of row-direction wiring lines, a plurality of column-direction wiring lines, insulating layers formed at intersections between the row-direction wiring lines and the column-direction wiring lines, a plurality of electron-emitting devices connected to the row-direction wiring lines and the column-direction wiring lines, and getters arranged on the wiring lines;

a circuit for sequentially applying a selection potential to the plurality of row-direction wiring lines; and a controlled constant current application circuit for applying a controlled current to the plurality of column-direction wiring lines.

This invention is especially effective in an arrangement in which the getter is arranged on the row-direction wiring line.

Another invention of an electron source according to the present application has the following arrangement.

An electron source comprises:

an electron source substrate which has on a substrate a plurality of row-direction wiring lines, a plurality of column-direction wiring lines, insulating layers formed at intersections between the row-direction wiring lines and the column-direction wiring lines, and a plurality of electron-emitting devices connected to the row-direction wiring lines and the column-direction wiring lines, the wiring lines being electrically connected to getters other than the electron-emitting devices;

a circuit for sequentially applying a selection potential to the plurality of row-direction wiring lines; and a controlled constant current application circuit for applying a controlled current to the plurality of column-direction wiring lines.

This invention is especially effective in an arrangement in which the getter is arranged to be electrically connected to the row-direction wiring line.

Each invention described above is particularly effective when the electron-emitting device is an electron-emitting device in which a current flowing into the electron-emitting device is larger than a current emitted by the electron-emitting device. For example, the arrangement of each invention is particularly effective for a surface-conduction emission type electron-emitting device since a current flowing into the electron-emitting device is much larger than an emitted current.

The getter in each invention described above has characteristics of adsorbing substances in the atmosphere. The getter is preferably a metal or alloy containing at least any one of Ti, Zr, Hf, V, Nb, Ta, and W.

Since the electron source of each invention described above has a getter, a gas discharged by the electron-emitting device itself or a gas discharged by a member irradiated with an emitted electron beam are rapidly exhausted. By electrically connecting the getter to a wiring line such that the getter is arranged on the wiring line, the potential of the getter is prevented from becoming unstable. Even if the resistance value of an electrical path extending from a driving circuit to an electron-emitting device varies owing to changes in getter over time, the controlled constant current application circuit is used to flow a predetermined current regardless of the resistance value of the electrical path. This suppresses variations in voltages applied to respective devices. As a result, an electron source having a long service life, almost no characteristic variations, and high uniformity can be attained.

The selection potential applied to the row-direction wiring line in each invention is a potential at which an electron-emitting device connected to a row-direction wiring line which receives the selection potential can emit electrons in cooperation with control from a column-direction wiring line. The selection potential is sequentially applied to row-direction wiring lines to line-sequentially drive devices.

The circuit for sequentially applying the selection potential to row-direction wiring lines and the controlled current application circuit in each invention can adopt various arrangements, and can be implemented as an integrated circuit.

In each invention, an arrangement in which the row-direction wiring lines are arranged on the column-direction wiring lines via insulating layers is preferable.

An image forming apparatus having an electron source and a substrate which has an image forming member for forming an image by irradiation of electrons from the electron source and is arranged to face the electron source can preferably employ an arrangement using the electron source of each invention as the electron source. As the image forming member, fluorescent substances can be suitably adopted. According to the present application, an image forming apparatus having a long service life, almost no characteristic variations, and high uniformity can be attained.

BRIEF DESCRIPTION OF DRAWINGS

FIGS. 5A to 5D show sectional views of the steps in forming the electron source apparatus shown in FIG. 1 and the like;

FIGS. 6A to 6C show plan views of the steps in forming the electron source apparatus shown in FIG. 1 and the like;

FIGS. 7A–7C show plan views of the steps in forming the electron source apparatus shown in FIG. 1 and the like;

BEST MODE FOR CARRYING OUT THE INVENTION

Figure 1:
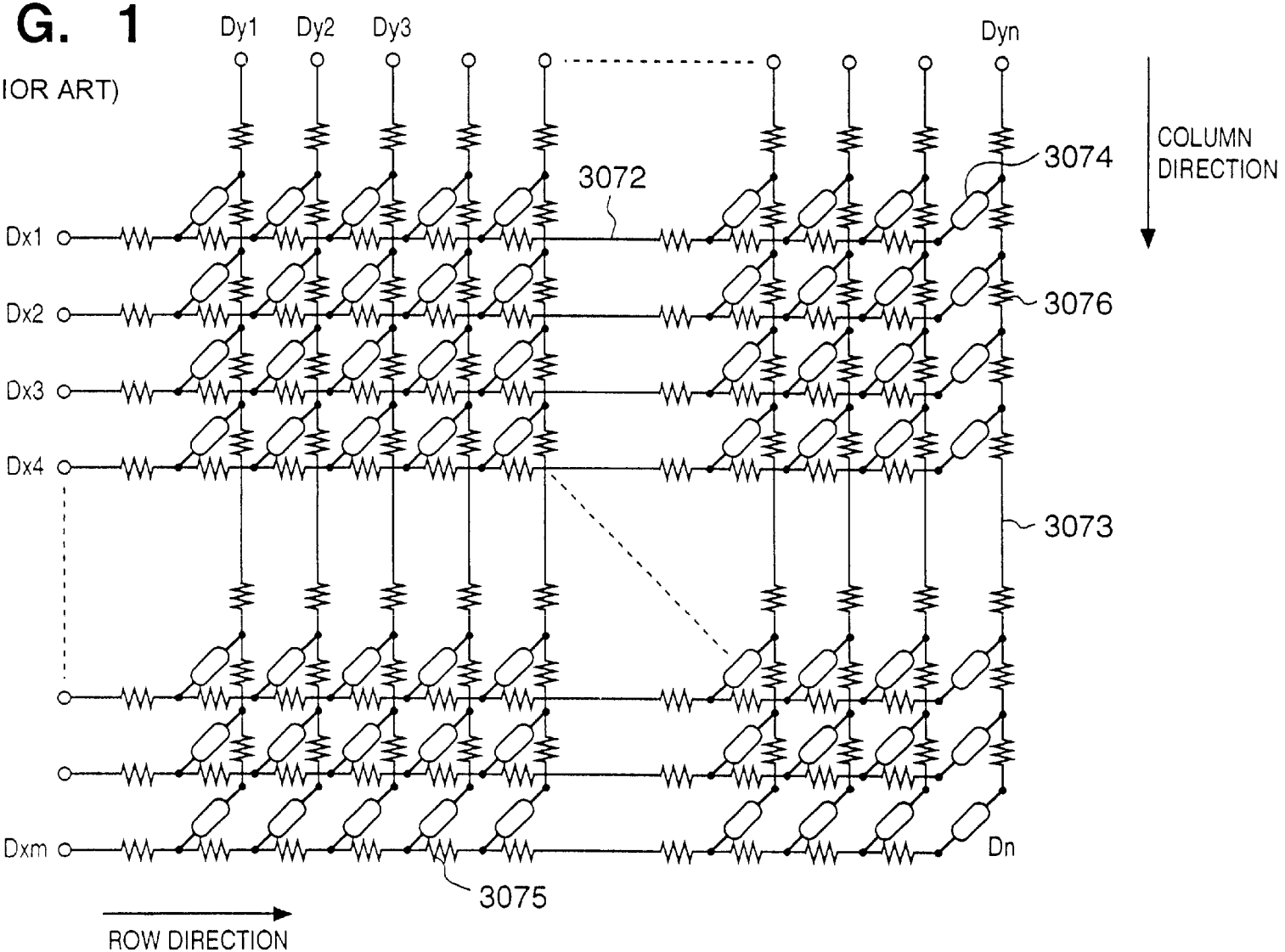
FIG. 1 (PRIOR ART)
FIG. 1 is a circuit diagram showing matrix wiring in a conventional electron source apparatus.
Figure 2:
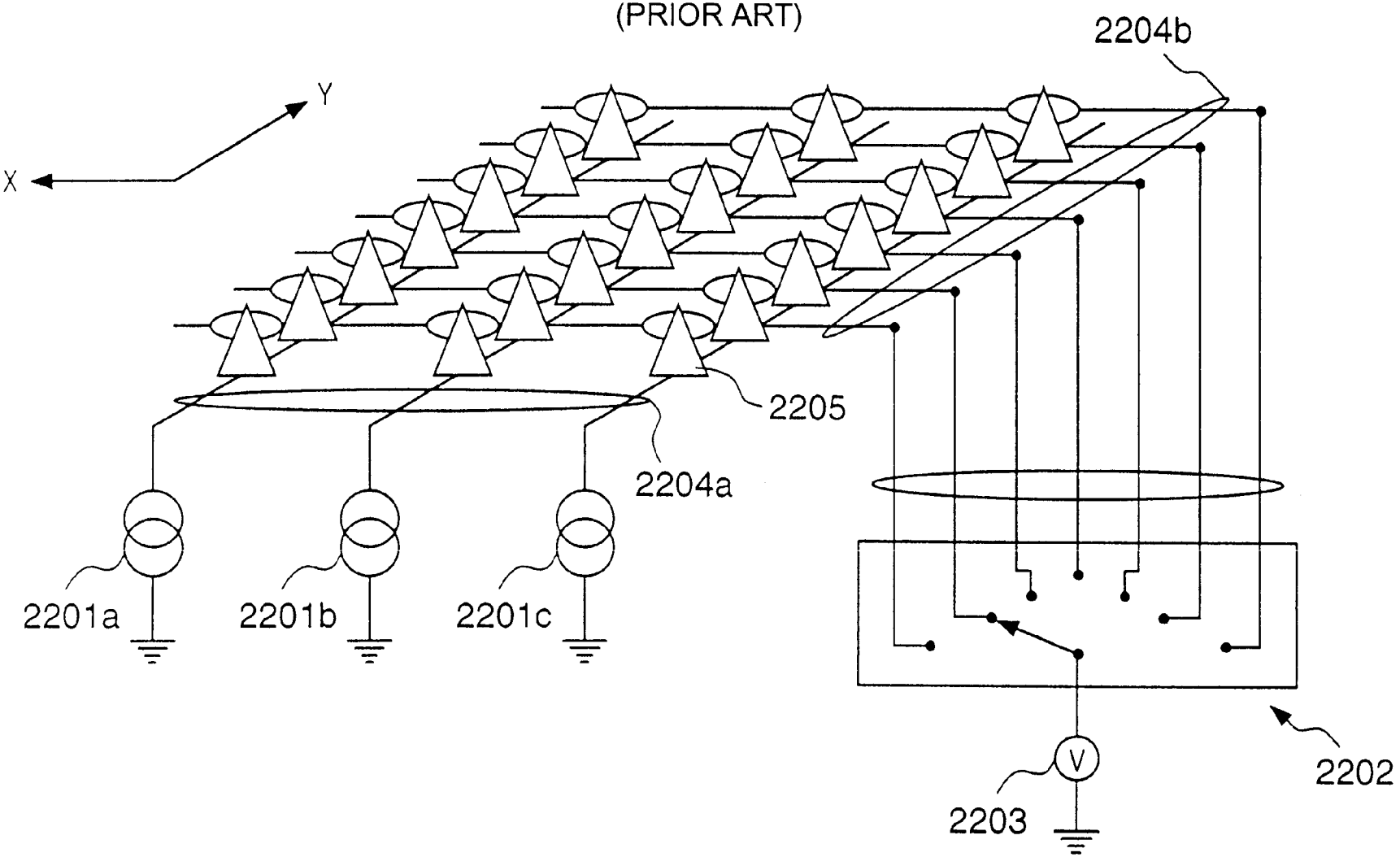
FIG. 2 (PRIOR ART)
FIG. 2 is a schematic view showing a conventional electron source apparatus using an FE type device.
Figure 3:
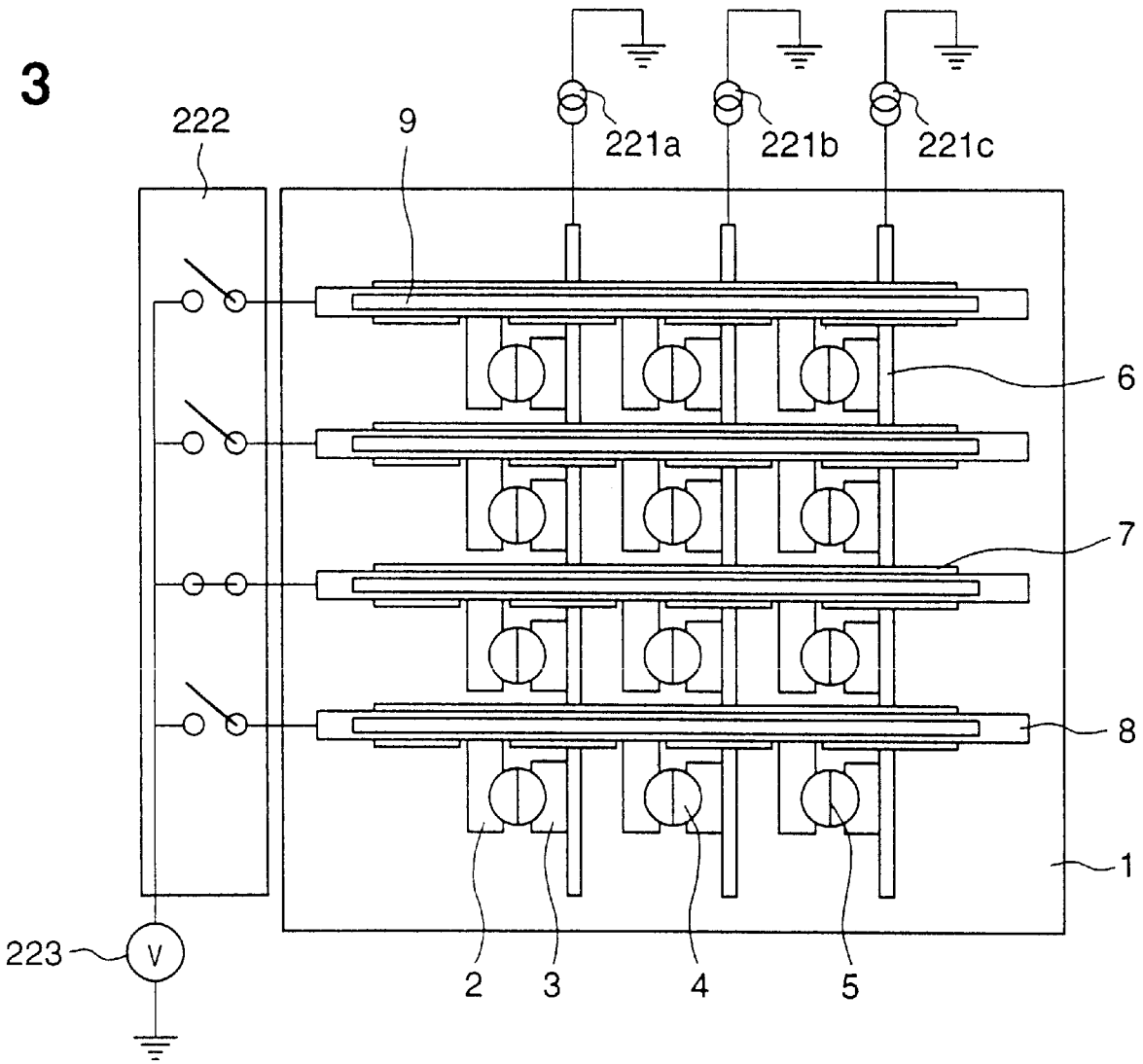
FIG. 3 is a schematic plan view showing an embodiment of an electron source apparatus according to the present invention.
Figure 4:
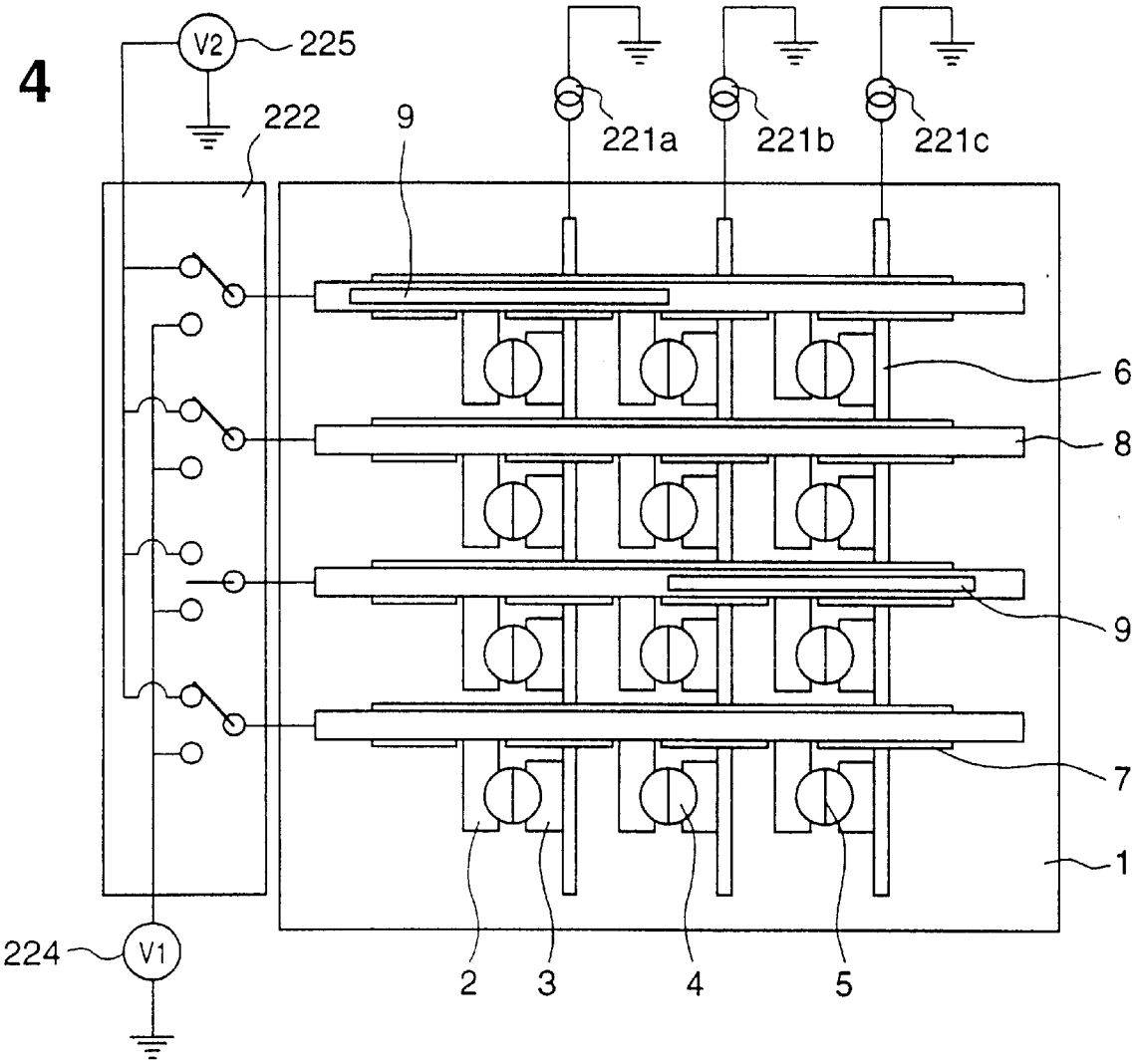
FIG. 4 is a schematic plan view showing another embodiment of an electron source apparatus according to the present invention.

FIGS. 3 and 4 are schematic plan views showing an embodiment of an electron source apparatus according to the present invention. The electron source apparatus of this embodiment uses a surface-conduction emission type electron-emitting device, but the present invention can also be suitably applied to another type of cold cathode electron-emitting device such as an FE type or MIM type device. For descriptive convenience, FIGS. 3 and 4 show an electron source apparatus having 4×3=12 electron-emitting devices. In practice, in the electron source apparatus of this embodiment, 500 devices in the row direction and 1,500 devices in the column direction are arrayed in a matrix.

As shown in FIGS. 3 and 4, each electron-emitting device of the electron source apparatus is connected to a row-direction wiring line 8 and column-direction wiring line 6. A getter 9 is arranged on each row-direction wiring line 8. Although the getter 9 may be an evaporative getter or unevaporative getter, the unevaporative getter which can be formed in a wider area is preferably used. In an example shown in FIG. 3, the getters 9 are arranged on all the row-direction wiring lines 8. As shown in FIG. 4, the getters 9 may be arranged on some row-direction wiring lines 8 every proper number of row-direction wiring lines 8. In examples shown in FIGS. 3 and 4, the getters 9 are arranged on only the row-direction wiring lines 8. However, the getters 9 may be arranged on the column-direction wiring lines 6, or on both the row-direction wiring lines 8 and column-direction wiring lines 6. The arrangement positions of the getters 9 are appropriately set. Instead of arranging the getters 9 on the wiring lines 6 and 8, the wiring lines 6 and 8 themselves may be formed from a getter material.

The respective column-direction wiring lines 6 are connected to controlled constant current sources 221*a*, 221*b*, and 221*c* serving as controlled current application means. The controlled constant current source is a current source capable of outputting a desired current value.

The respective row-direction wiring lines 8 are connected to a voltage application means made up of a switching circuit and voltage source. As shown in FIG. 3, the switching circuit and voltage source may be constituted by a voltage source 223 and a switching circuit 222 for selecting the row-direction wiring lines 8 while sequentially scanning them. As shown in FIG. 4, the switching circuit and voltage source may adopt two voltage sources 224 and 225, and apply a predetermined potential to row-direction wiring lines 8 other than a row-direction wiring line 8 selected by the switching circuit 222.

The arrangement shown in FIG. 4 can prevent unselected row-direction wiring lines 8 from floating, can also control a leakage current, and can be used more preferably than the arrangement shown in FIG. 3.

The electron source apparatus of the present invention will be explained in more detail with reference to an embodiment.

This embodiment will exemplify the steps in forming an electron source apparatus using a surface-conduction emission type electron-emitting device, and an image forming apparatus using the electron source apparatus.

The steps in forming an electron source apparatus according to this embodiment will be described with reference to FIGS. 5 to 7. FIG. 5 shows sectional views of the steps in forming the electron source apparatus shown in FIG. 3 and the like. FIGS. 6 and 7 show plan views of the steps in forming the electron source apparatus shown in FIG. 3 and the like. In FIGS. 6 and 7, the electron source apparatus has nine electron-emitting devices for descriptive convenience.

Step 1: An $SiO_2$ layer was formed to a thickness of 0.5 $\mu$m on one major surface of soda-lime glass by sputtering, thereby obtaining a substrate 1.

Figure 5A:
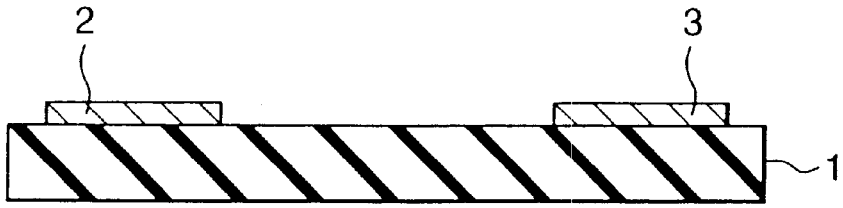
Figure 6A:
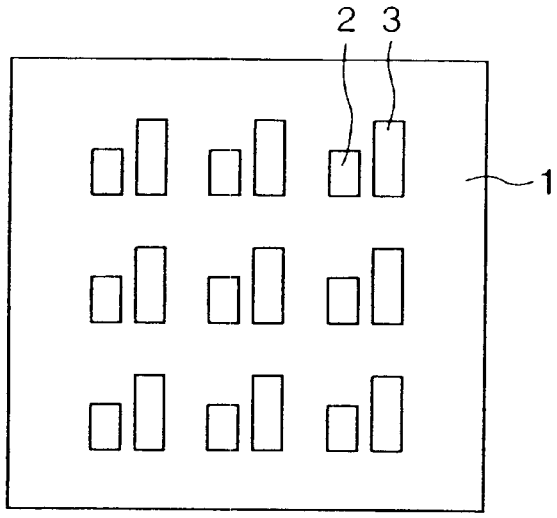

As shown in FIGS. 6*a* and 5*a*, 500×1,500 pairs of device electrodes 2 and 3 were formed. Formation of the device electrodes 2 and 3 used offset printing. More specifically, organic Pt paste containing Pt was applied to an intaglio plate having recesses corresponding to the pattern of the device electrodes 2 and 3, and this paste was transferred to the substrate 1. The transferred ink was heated and calcined to form device electrodes 2 and 3.

Figure 6B:
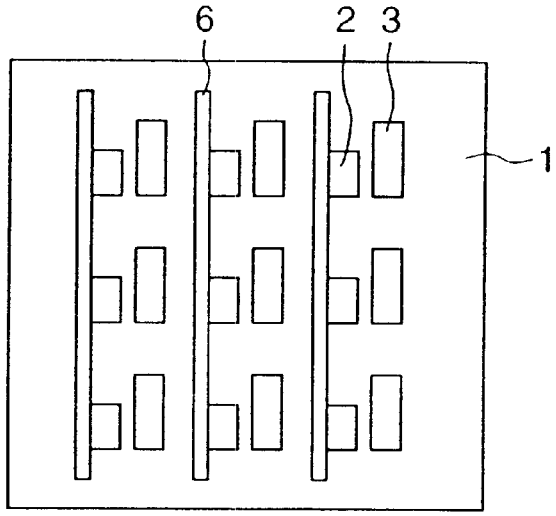

Step 2: As shown in FIG. 6*b*, column-direction wiring lines 6 (also called X-direction wiring lines or lower wiring lines) were formed to be connected to the device electrodes 2 each of which was one of the device electrodes. Formation of the column-direction wiring lines 6 used screen printing. More specifically, Ag paste was printed on the substrate 1 via a screen plate having openings corresponding to the pattern of the column-direction wiring lines 6, and the printed paste was heated and calcined to form Ag column-direction wiring lines 6.

Figure 6C:
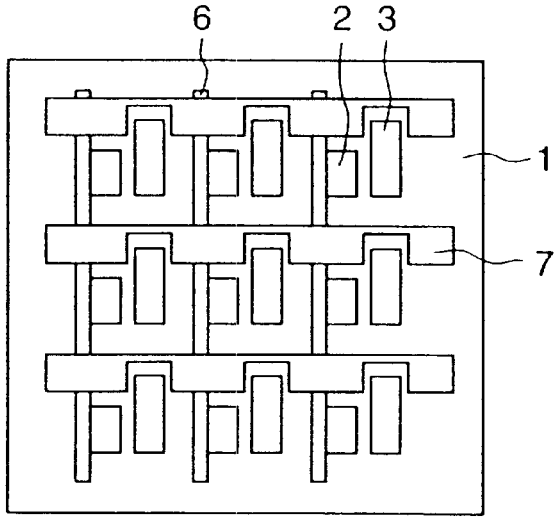

Step 3: As shown in FIG. 6*c*, interlevel insulating layers 7 were formed at intersections between the column-direction wiring lines 6 and row-direction wiring lines 8. Formation of the interlevel insulating layers 7 used screen printing. As shown in FIG. 6*c*, the shape of the interlevel insulating layer 7 was a comb finger shape which covered the intersection between the column-direction wiring line 6 and the row-direction wiring line 8, and had a recess at which the row-direction wiring line 8 and the device electrode 3 could be connected to each other. More specifically, glass paste which mainly contained lead oxide and was prepared by mixing a glass binder and resin was printed on the substrate 1, and the printed paste was heated and calcined to form interlevel insulating layers 7.

Figure 7A:
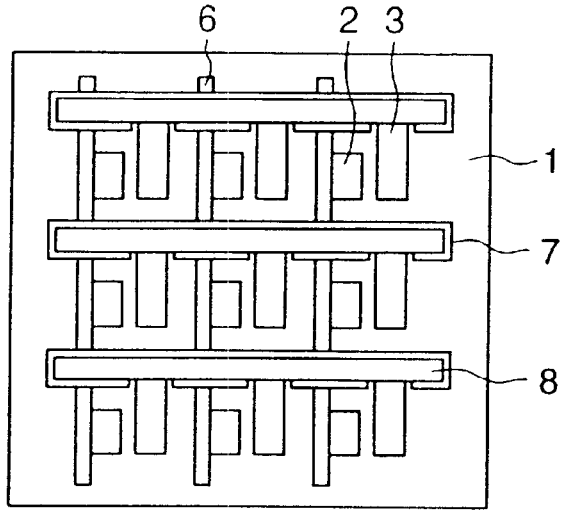

Step 4: As shown in FIG. 7*a*, row-direction wiring lines 8 (also called Y-direction wiring lines or upper wiring lines) were formed to be connected to the device electrodes 3 each of which was one of the device electrodes. Formation of the row-direction wiring lines 8 employed screen printing. More specifically, Ag paste was printed on the substrate 1 via a screen plate having openings corresponding to the pattern of the row-direction wiring lines 8, and the printed paste was heated and calcined to form Ag row-direction wiring lines 8.

Figure 5B:
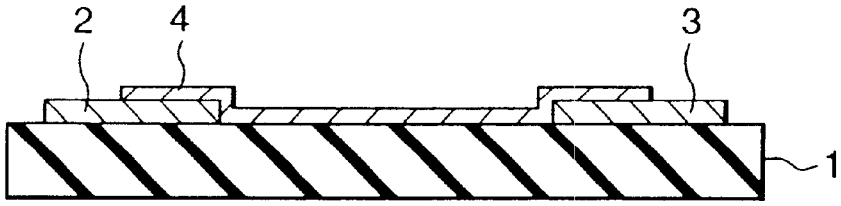
Figure 7B:
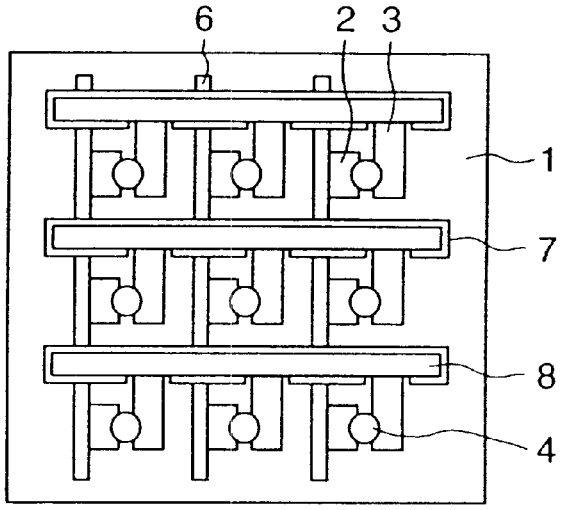
Figure 7C:
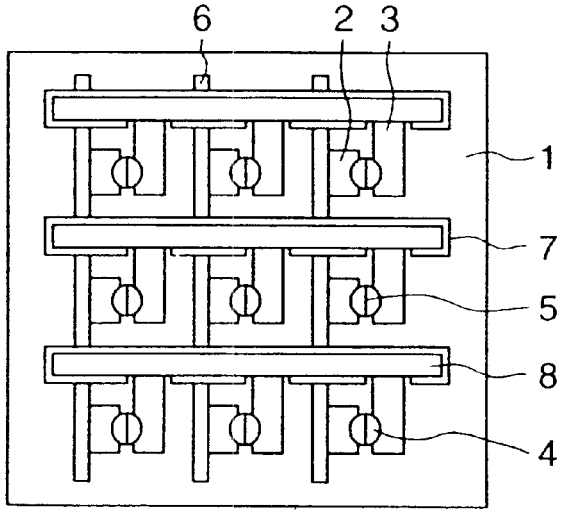

Step 5: As shown in FIGS. 5*b* and 7*b*, conductive films 4 were formed to connect the device electrodes 2 and 3. Formation of the conductive films 4 used a bubble-jet method as one of ink-jet methods. More specifically, droplets of an aqueous solution of 0.15% of a Pd organic metal compound, 15% of isopropyl alcohol, 1% of ethylene glycol, and 0.05% of polyvinyl alcohol were applied between the device electrodes 2 and 3 by the ink-jet method.

Subsequently, the droplets were calcined in the atmosphere at 350° C. to form PdO conductive films 4. The PdO film thickness was about 15 nm. Although this embodiment adopted the ink-jet method, formation of the conductive films 4 can use another method such as sputtering.

Step 6: An unevaporative getter (not shown) was applied on each row-direction wiring line 8 via a mask by a reduced-pressure plasma spraying method. The getter material was a Zr-Fe-V alloy.

By these steps, an electron source substrate before forming processing was formed.

Step 7: The electron source substrate 1 before forming processing was placed in a chamber (not shown), and the interior of the chamber was evacuated to about $10^{-5}$ [Torr].

Figure 5C:
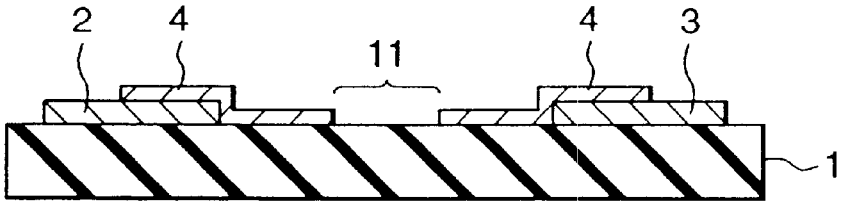
Figure 5D:
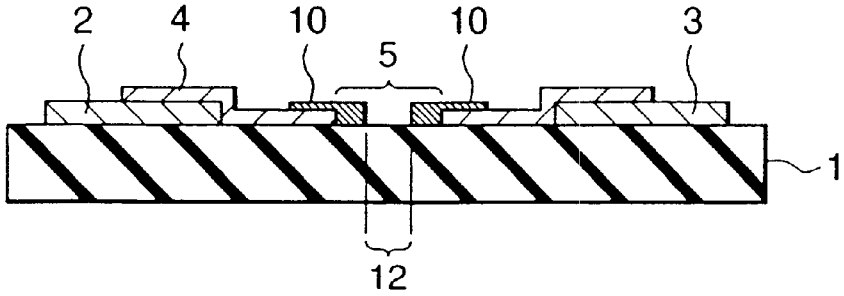

As shown in FIG. 5*c*, electrification forming processing was executed via the column-direction wiring lines 6 and row-direction wiring lines 8 to form gaps 11 in part of the conductive films 4. The maximum voltage applied in the forming step was 5.1 V.

Then, electrification activation processing was done to form carbon films 10 in the gaps 11 formed by forming processing and on the conductive films 4 near the gaps, thereby forming electron-emitting portions 5. In the electrification activation step, an organic gas (benzonitrile) was introduced into the chamber to $10^{-4}$ [Torr], and brought into contact with the gaps 11. In this state, a constant voltage pulse of 15 V was applied to the conductive films 4 via the column-direction wiring lines 6 and row-direction wiring lines 8.

Step 8: While the chamber and electron source substrate 1 were heated, the interior of the chamber was evacuated until the internal pressure of the chamber reached $10^{-10}$ [Torr].

By these steps, the electron source substrate 1 was formed.

Figure 8:
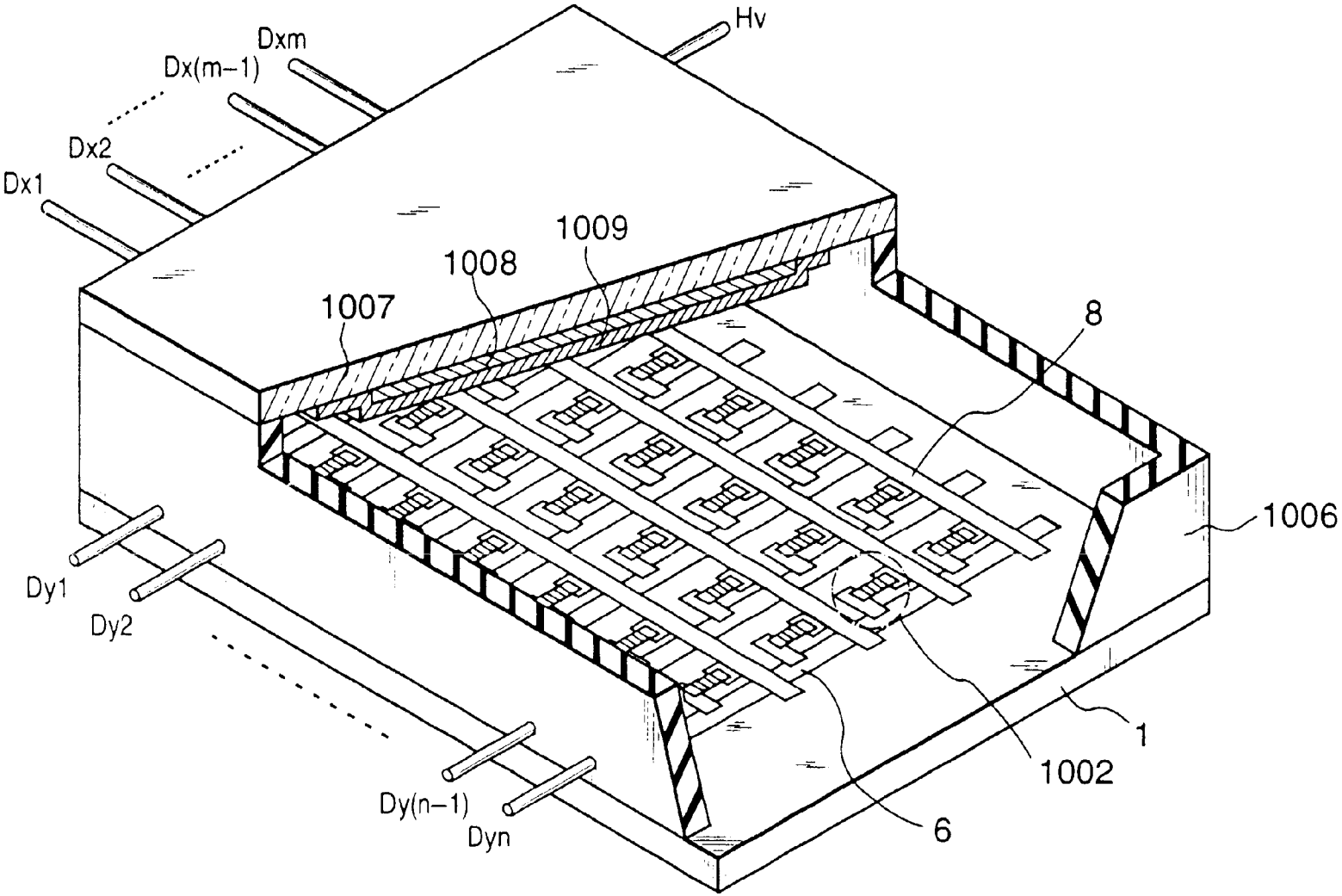
FIG. 8 is a perspective view showing an embodiment of a display panel (image forming apparatus) according to the present invention.

An image forming apparatus shown in FIG. 8 was constructed using the electron source substrate 1 formed in the above manner.

FIG. 8 is a partially cutaway perspective view of the display panel (image forming apparatus) used in this embodiment showing the internal structure of the display panel.

In FIG. 8, reference numeral 1 denotes the electron source substrate (rear plate); 1006, a side wall; and 1007, a face plate. The electron source substrate 1, side wall 1006, and face plate 1007 constitute an airtight container for keeping the interior of the display panel vacuum. To construct the airtight container, the electron source substrate 1, side wall 1006, and face plate 1007 must be sealed to obtain sufficient strength and maintain airtight condition at the joint portions of the respective members. For example, frit glass was applied to the joint portions, and calcined in the atmosphere or nitrogen atmosphere to seal the members. A method of evacuating the interior of the airtight container will be described later.

Figure 9:
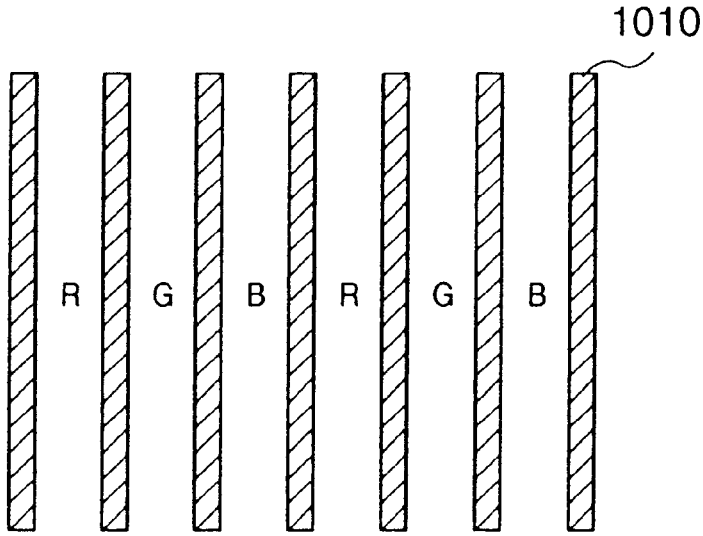
FIG. 9 is a view showing the coating pattern of fluorescent substances in the fluorescent film of the display panel (image forming apparatus) shown in FIG. 8.

A fluorescent film 1008 is formed on the lower surface of the face plate 1007. Since this embodiment relates to a color display apparatus, the fluorescent film 1008 is coated with fluorescent substances of red (R), green (G) and blue (B), i.e., three primary colors used in the CRT field. As shown in FIG. 9, fluorescent substances of the respective colors are formed into stripes, and black members 1010 are formed between the stripes of the fluorescent substances. The purposes of forming the black members 1010 are to prevent display color misregistration even if the irradiation position of an electron beam is shifted to some extent, and to prevent degradation of display contrast by shutting off reflection of external light. The black members 1010 are formed from graphite as a main component, but may be formed from another material so long as the above purpose is attained.

Figure 10:
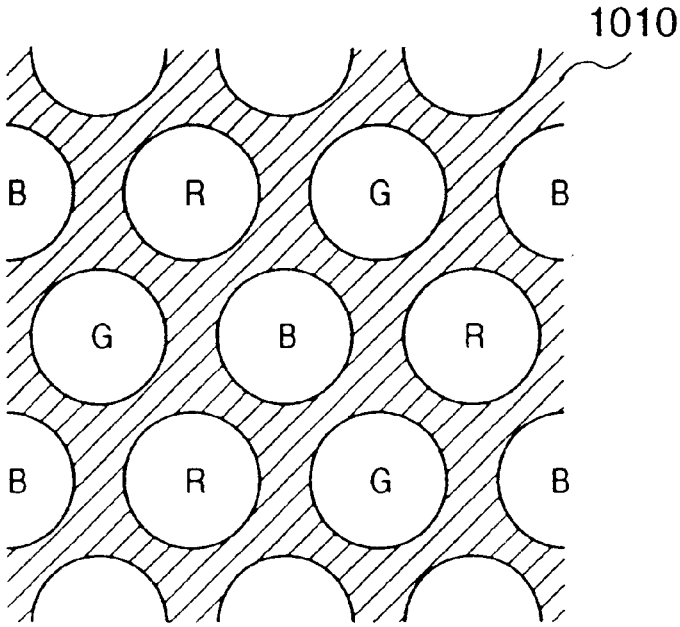
FIG. 10 is a view showing another coating pattern of fluorescent substances in the fluorescent film of the display panel (image forming apparatus) shown in FIG. 8.

The coating pattern of the fluorescent substances of the three primary colors is not limited to stripes shown in FIG. 9, but may be a delta pattern as shown in FIG. 10 or another pattern.

Note that when a monochrome display panel is to be formed, fluorescent substances of a single color maybe used as the fluorescent substances 1008, and the black member need not always be used.

A metal back 1009, which is well-known in the CRT field, is formed on the fluorescent film 1008 on the rear plate side. The purposes of forming the metal back 1009 are to improve the light utilization ratio by mirror-reflecting part of the light emitted by the fluorescent film 1008, to protect the fluorescent film 1008 from collision with negative ions, to use the metal back 1009 as an electrode for applying an electron beam accelerating voltage of, e.g., 10 kV, to use the metal back 1009 as a conductive path of electrons which excited the fluorescent film 1008, and the like. The metal back 1009 was formed by forming the fluorescent film 1008 on the face plate substrate 1007, smoothing the surface of the fluorescent film, and depositing aluminum on the smoothed surface by vacuum deposition.

To apply an accelerating voltage or improve the conductivity of the fluorescent film, e.g., ITO transparent electrodes may be formed between the face plate substrate 1007 and the fluorescent film 1008 though these electrodes were not used in this embodiment.

Reference symbols Dx1 to Dxm and Dy1 to Dyn denote feeding terminals of an airtight structure in order to electrically connect the display panel to an electric circuit. Dx1 to Dxm are electrically connected to the row-direction wiring lines 8 of the electron source; Dy1 to Dyn, to the column-direction wiring lines 6 of the electron source; and Hv, to the metal back 1009 of the face plate.

To evacuate the interior of the airtight container, an exhaust pipe and vacuum pump (neither is shown) were connected after the airtight container was assembled, and the airtight container was evacuated to a vacuum of about $10^{-7}$ [Torr]. While the airtight container was kept evacuated, the airtight container was heated to 300° C. This state was held for 10 h to activate the unevaporative getter formed in step 5. After that, the exhaust pipe was sealed.

The electron source, image display apparatus, and driving method therefor in this embodiment will be explained in detail.

Figure 11:
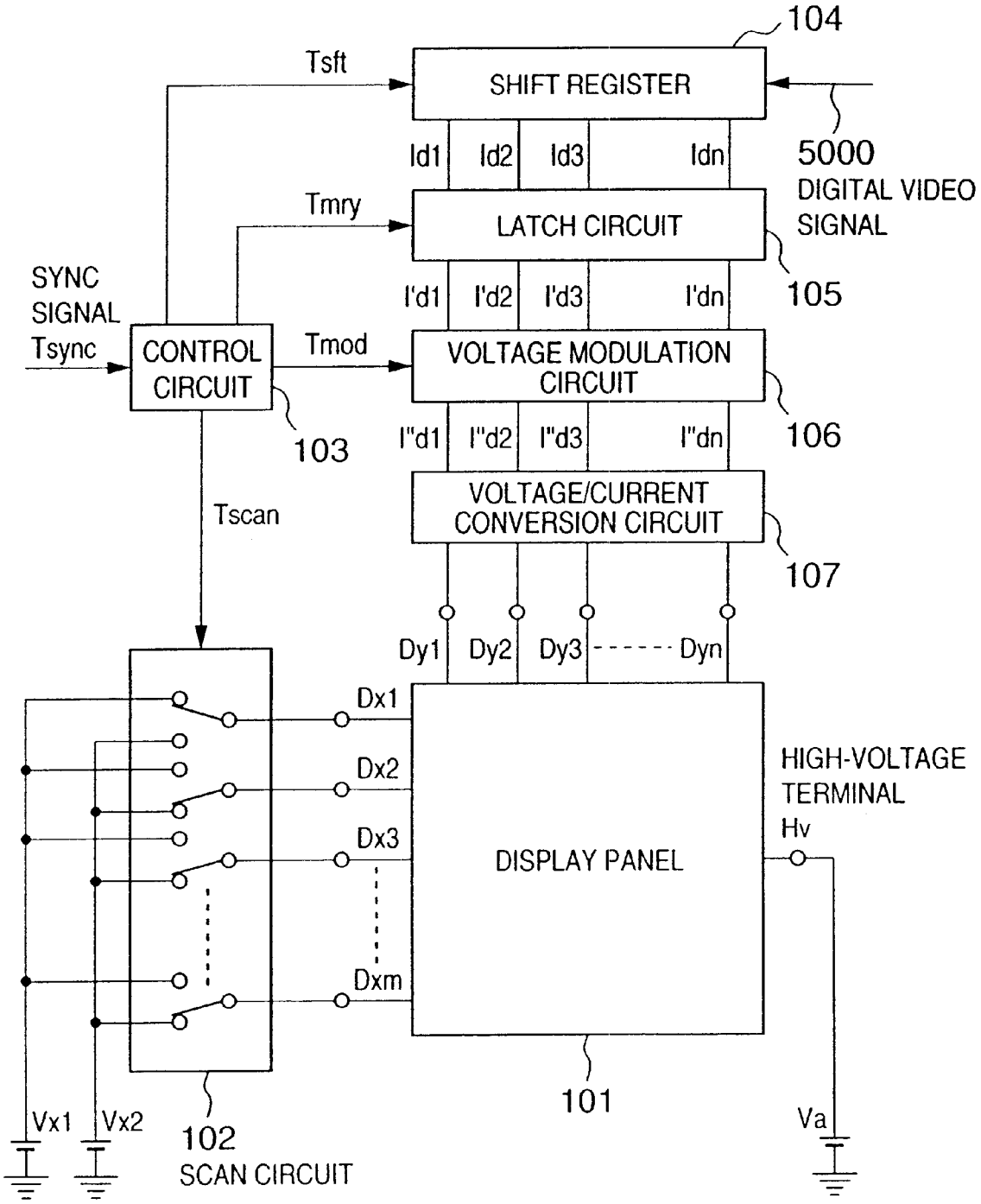
FIG. 11 is a block diagram showing the driving circuit of the display panel (image forming apparatus) shown in FIG. 8.

The image forming apparatus (display panel 101) formed in the above-described steps was connected to a circuit shown in FIG. 11.

In FIG. 11, the display panel 101 is connected to an external circuit via the terminals Dx1 to Dxm (m=500) and the terminals Dy1 to Dyn (n=1,500). The high-voltage terminal Hv on the face plate is connected to an external high-voltage power supply Va to accelerate emitted electrons. The terminals Dx1 to Dxm receive scan signals for sequentially driving the multi electron beam source formed in the above-described panel, i.e., the surface-conduction emission type electron-emitting devices wired in a matrix of 500 rows and 1,500 columns in units of rows. The terminals Dy1 to Dyn receive modulation signals for controlling electron beams output from the respective surface-conduction emission type electron-emitting devices on one row selected by the scan signal.

A scan circuit 102 will be explained. This circuit incorporates 500 switching elements. On the basis of a control signal Tscan generated by a control circuit 103, each switching element connects a DC power supply Vx1 to the wring terminal of a scanned electron-emitting device row, and a DC power supply Vx2 to the terminal of an unscanned electron-emitting device row. Each switching element can be easily formed from a switching element such as an FET. The output voltages of Vx1 and Vx2 will be described later.

The control circuit 103 matches the operation timings of respective circuits so as to attain proper display based on an externally input image signal. The externally input image signal includes a composite signal of image data and a sync signal, like an NTSC signal, or image data and a sync signal which are separated in advance. In this embodiment, the latter signal will be described. (Note that the former image signal can also be processed as follows by adopting a well-known sync separation circuit and separating image data and a sync signal from each other.)

More specifically, the control circuit 103 generates control signals Tscan and Tmry on the basis of the externally input sync signal Tsync. In general, the sync signal includes a vertical sync signal and horizontal sync signal. In this case, however, the sync signal is represented by Tsync for descriptive convenience.

Externally input image signal (luminance data) is input to a shift register 104. The shift register 104 serial/parallelconverts in units of lines of an image the image data serially input in time-series. The shift register 104 operates on the basis of the control signal (shift signal) Tsft input from the control circuit 103. Data of one line of another parallel-converted image (corresponding to driving data of N electron-emitting devices) are output as parallel signals Id1 to Idn to a latch circuit 105.

The latch circuit 105 is a memory circuit for storing data of one line of an image for a necessary time, and simultaneously stores Id1 to Idn in accordance with a control signal Tmry sent from the control circuit 103. The stored data are output as I'd1 to I'dn to a voltage modulation circuit 106.

The voltage modulation circuit 106 outputs, as I"d1 to I"dn, voltage signals whose amplitudes are modulated in accordance with the image data I'd1 to I'dn. More specifically, the voltage modulation circuit 106 outputs a voltage pulse having a larger amplitude for a higher luminance level of image data. For example, the voltage modulation circuit 106 outputs a voltage of 2 [V] for the maximum luminance, and a voltage of 0 [V ] for the minimum luminance. The output signals I"d1 to I"dn are input to a voltage/current conversion circuit 107.

The voltage/current conversion circuit 107 is a circuit (controlled current application means) for controlling a current to be flowed through a surface-conduction emission type electron-emitting device in accordance with the amplitude of an input voltage signal. An output signal from the circuit 107 is applied to the terminals Dy1 to Dyn of the display panel 101.

Figure 12:
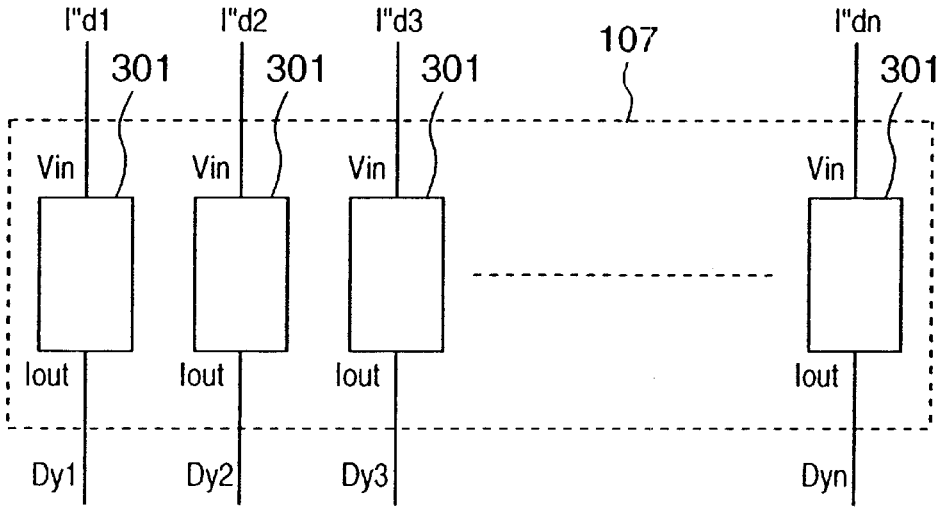
FIG. 12 is a view showing the internal arrangement of a voltage/current conversion circuit shown in FIG. 11.

FIG. 12 is a view showing the internal arrangement of the voltage/current conversion circuit 107 shown in FIG. 11. As shown in FIG. 12, the voltage/current conversion circuit 107 incorporates voltage/current converters 301 in correspondence with the input signals I"d1 to I"dn.

Figure 13:
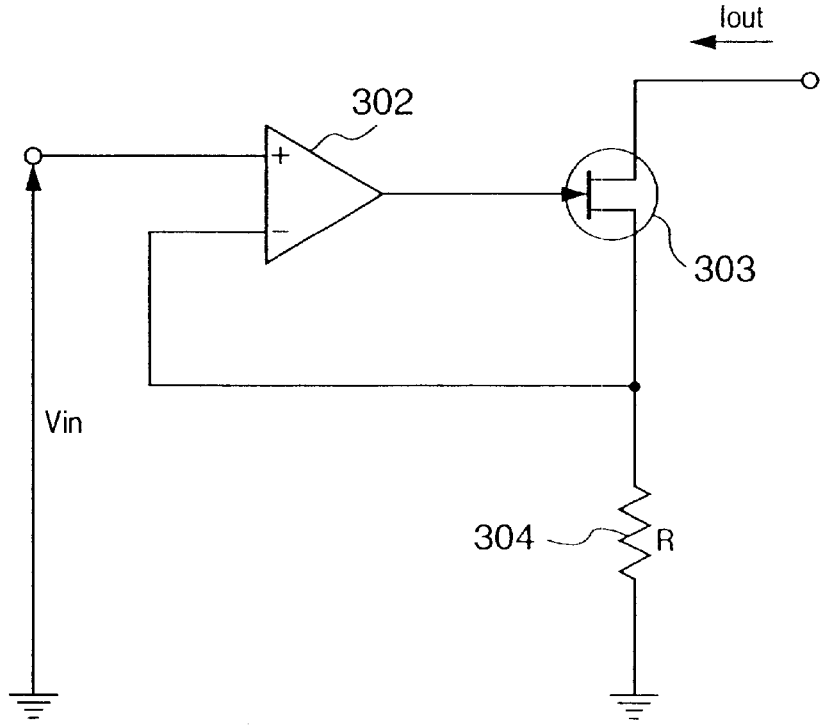
FIG. 13 is a circuit diagram showing a voltage/current converter shown in FIG. 12.

Each voltage/current converter 301 is constituted by a circuit as shown in FIG. 13. In FIG. 13, reference numeral 302 denotes an operational amplifier; 303, e.g., a junction FET type transistor; and 304, a resistor of R [Ω]. The circuit in FIG. 13 determines the magnitude of a current Iout to be output in accordance with the amplitude of an input voltage signal Vin. This current Iout satisfies $$Iout=Vin/R \quad (1)$$

By setting the design parameter of the voltage/current converter 301 to a proper value, the current Iout to be flowed through a surface-conduction emission type electron-emitting device can be controlled in accordance with the voltage-modulated image data Vin.

In this embodiment, a resistance R of the resistor 304 and another design parameter are determined as follows.

Figure 14:
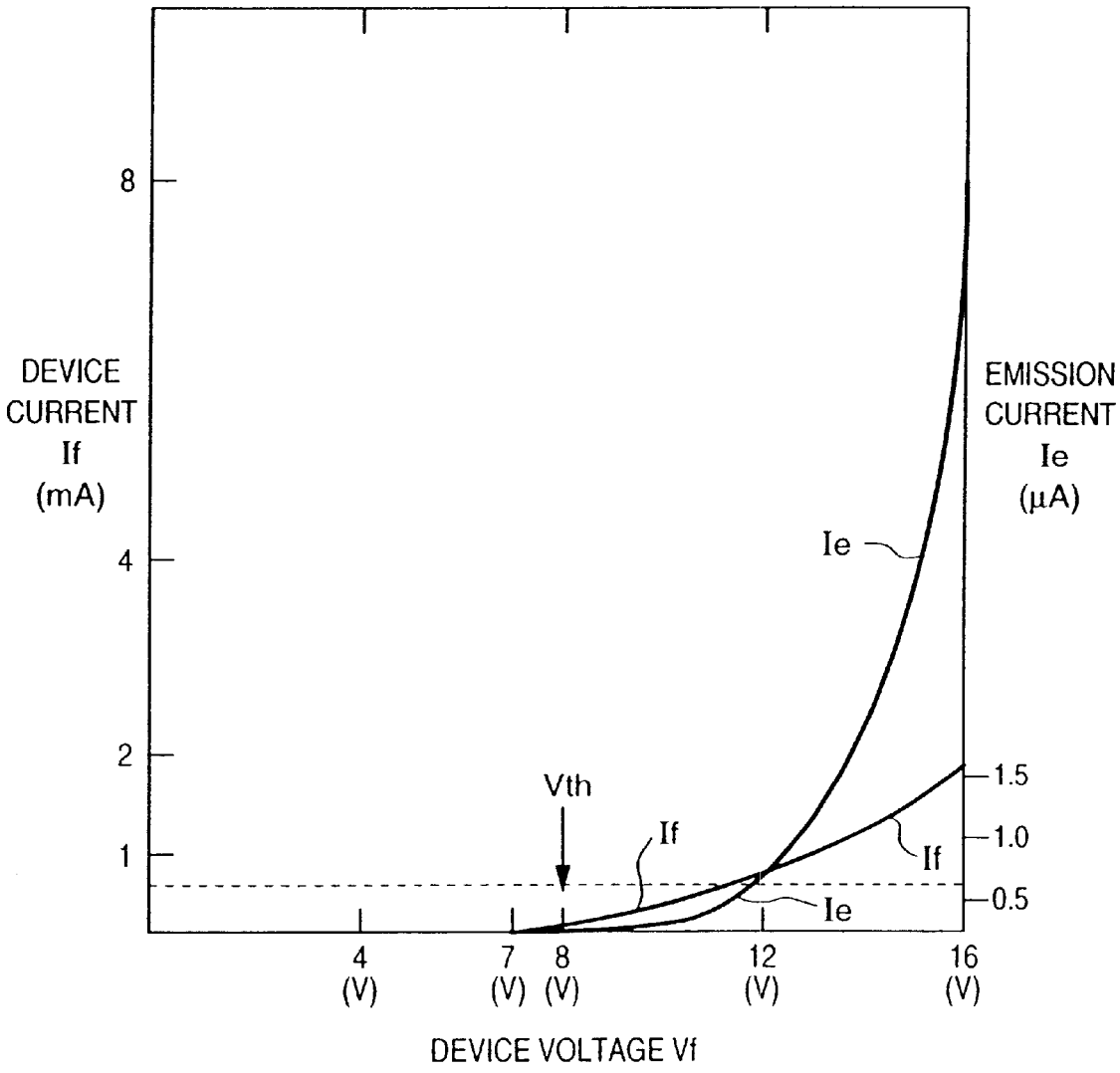
FIG. 14 is a graph showing the electron emission characteristic of an electron-emitting device in the display panel (image forming apparatus) shown in FIG. 8.

That is, the surface-conduction emission type electron-emitting device used in this embodiment has an electron emission characteristic having Vth=8 [V] as a threshold voltage, as shown in FIG. 14. To prevent unwanted emission of the display screen, a voltage applied to an unscanned electron-emitting device row must necessarily be lower than 8 [V]. Since the scan circuit 102 in FIG. 11 applies the output voltage of the voltage source Vx2 to the row-direction wiring line of an unscanned electron-emitting device row, the voltage source Vx2 must satisfy $$Vx2<8 \quad (2)$$

For this purpose, this embodiment defined the voltage of Vx2 to 7.5 [V]. Hence, the voltage applied to an unscanned electron-emitting device does not exceed 7.5 [V] at maximum.

Figure 15:
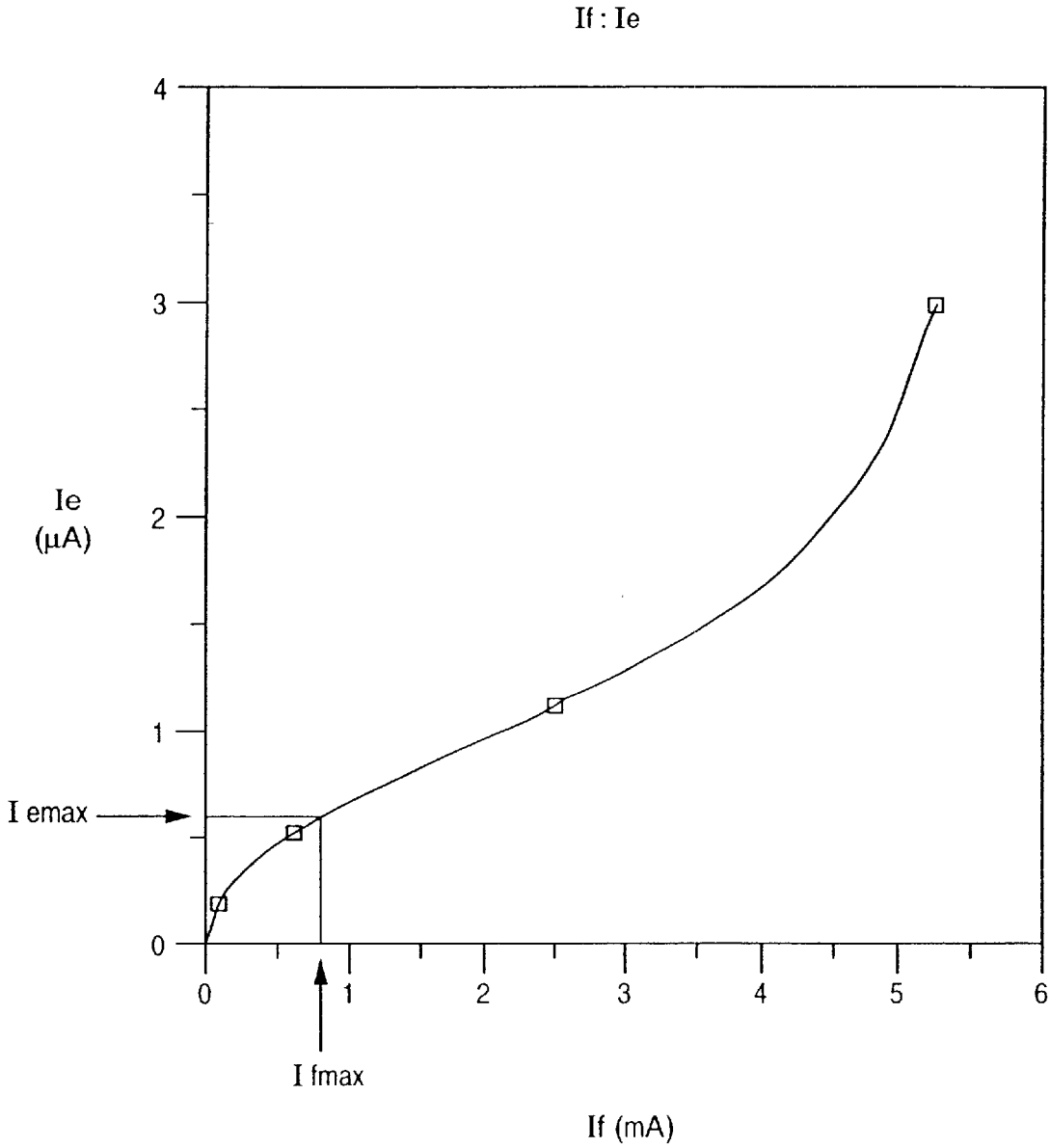
FIG. 15 is a graph showing the correlation between an emission current Ie and device current If of the electron-emitting device in the display panel (image forming apparatus) shown in FIG. 8.

An electron-emitting device during scanning must appropriately emit an electron beam in accordance with image data. In this embodiment, an emission current Ie was controlled by properly modulating a device current If using the If-Ie characteristic of the surface-conduction emission type electron-emitting device shown in FIG. 15. As shown in FIG. 15, an emission current in causing the display apparatus to emit light at the maximum luminance was set to Iemax, and the device current at this time was set to Ifmax. For example, Iemax=0.6 [μA], and Ifmax =0.8 mA].

The voltage Vin of an output signal from the voltage modulation circuit 106 is 2 [V] for the maximum luminance and 0 [V] for the minimum luminance, and is substituted into equation (1) to determine the resistance R to $$R=2/0.0008=2.5[k\Omega].$$

In emitting light at the maximum luminance, the surface-conduction emission type electron-emitting device has an electrical resistance:

$$12[V]/0.8[mA]=15[k\Omega]$$

Considering that this surface-conduction emission type electron-emitting device was series-connected to the resistance R (=2.5[kΩ]), the output voltage of the voltage source Vx1 was set to $$Vx1=15\ [V]$$

An accelerating voltage Va applied to fluorescent substances was determined as follows. That is, application power to fluorescent substances necessary for obtaining a desired maximum luminance was calculated from the emission efficiency of fluorescent substances, and the magnitude of the accelerating voltage Va was determined to 10 [kV] so as to set (Iemax×Va) to satisfy the application power.

In this way, the parameters were set.

As described above, this embodiment used the relationship between the device current If and emission current Ie of the surface-conduction emission type electron-emitting device shown in FIG. 15. The device current If was modulated in accordance with image data to control the emission current Ie and attain gray-level display.

When no controlled constant current source was used, the current If applied to the surface-conduction emission type electron-emitting device gradually varied, and luminance faithful to image data was not reproduced. When a controlled constant current source was used, like this embodiment, the luminance did not vary, and no color misregistration occurred. At the same time, degradation of electron emission characteristics supposed to be caused by a gas discharged along with driving could be suppressed.

Since Vx2 was applied to an unselected row, and the voltage/current conversion circuit 107 modulated the device current If flowing through the surface-conduction emission type electron-emitting device, the leakage current could be kept constant, and an image could be displayed on the entire display screen at a luminance faithful to an original image signal.

This embodiment has described an arrangement shown in FIG. 12 as an embodiment of the voltage/current conversion circuit 107. However, the circuit arrangement is not limited to this as far as the voltage/current conversion circuit 107 can modulate a current flowing through a load resistor (surface-conduction emission type electron-emitting device) in accordance with an input voltage. For example, when a relative large output current Iout is required, a power transistor is desirably Darlington-connected to the transistor 303.

This embodiment employs peak value modulation of modulating the magnitude of If in accordance with an image signal. In practicing the present invention, the method is not limited to this, and pulse width modulation can also be employed. In this case, it is suitable to modulate the application time while keeping If constant.

This embodiment uses as an input video signal a digital video signal which can easily undergo data processing. However, this is not limited to a digital video signal, and may be an analog video signal.

This embodiment adopts for serial/parallel conversion processing the shift register 104 which can easily process a digital signal. However, the present invention is not limited to this, and may use a random access memory having a function equivalent to the shift register by controlling a storage address and sequentially changing the storage address.

As described above, this embodiment could suppress variations in voltage effectively applied to a device that are caused by changes in wiring resistance over time. At the same time, since the getter was arranged near the device, a gas discharged by the electron-emitting device itself or a gas discharged by a member irradiated with an emitted electron beam could be rapidly exhausted to suppress degradation of electron emission characteristics for a long time. As a result, a high-quality image almost free from a luminance distribution could be formed.

As has been described above, the present invention comprises a means for sequentially applying a selection potential to a plurality of row-direction wiring lines, and a controlled constant current application means for applying a controlled current to a plurality of column-direction wiring lines. Thus, the present invention can suppress variations in voltage effectively applied to an electron-emitting device that are caused by changes in wiring resistance over time. Since the getter is arranged near an electron-emitting device, the present invention can suppress degradation of electron emission characteristics for a long time. Hence, the present invention can provide an electron source and image forming apparatus which have long service lives, almost no characteristic variations, and high uniformity.

INDUSTRIAL APPLICABILITY

The invention of the present application can be used in the field of electron source apparatuses, and more particularly in the field of image forming apparatuses.

What is claimed is:

1. An electron source comprising:

an electron source substrate which has on a substrate a plurality of row-direction wiring lines, a plurality of column-direction wiring lines, insulating layers formed at intersections between the row-direction wiring lines and the column-direction wiring lines, a plurality of electron emitting devices connected to the row-direction wiring lines and the column-direction wiring lines, and getters arranged on the wiring lines;

a circuit for sequentially applying a selection voltage to the plurality of row-direction wiring lines; and a controlled current application circuit for applying a controlled current, so as to emit a desired amount of electrons, to the plurality of column-direction wiring lines, wherein changes in the getters over time lead to changes in the resistance of the wiring line on which the getters are arranged, and wherein the controlled constant current application circuit applies a predetermined current regardless of the resistance of the wiring line on which the getters are arranged.

2. The electron source according to claim 1, wherein said getter is arranged on the row-direction wiring line.

3. An electron source comprising:

an electron source substrate which has on a substrate a plurality of row-direction wiring lines, a plurality of column-direction wiring lines, insulating layers formed at intersections between the row-direction wiring lines and the column-direction wiring lines, a plurality of electron-emitting devices connected to the row-direction wiring lines and the column-direction wiring lines, the wiring lines being electrically connected to getters;

a circuit for sequentially applying a selection voltage to the plurality of row-direction wiring lines; and a controlled constant current application circuit for applying a controlled constant current to the plurality of column-direction wiring lines, wherein changes in the getter over time lead to changes in the resistance of the wiring line on which the getter is arranged, and wherein the current application circuit applies a predetermined current to the plurality of column-direction wiring lines in accordance with image data, regardless of the resistance of the wiring lines on which the getters are arranged.

4. The electron source according to claim 3, wherein said getters are arranged to be electrically connected to the row-direction wiring lines.

5. The electron source according to any one of claims 1 to 4, said electron-emitting device is an electron-emitting device in which a current flowing into the electron-emitting device is larger than a current emitted by the electron-emitting device.

6. An image forming apparatus which has an electron source and an image forming member for forming an image by irradiation of electrons from said electron source, wherein said electron source is the electron source according to any one of claims 1 to 4.

* * * * *

UNITED STATES PATENT AND TRADEMARK OFFICE

CERTIFICATE OF CORRECTION

PATENT NO. : 6,624,586 B2
DATED : September 23, 2003
INVENTOR(S) : Naoto Abe et al.

It is certified that error appears in the above-identified patent and that said Letters Patent is hereby corrected as shown below:

Column 1,
Line 25, “Phys.,” should read -- Phys.”, --;
Line 35, “M.” should read -- [M.--;
Line 36, “(1975)] ,” should read -- (1975)], --;
Line 42, “Advance” should read -- Advances --;
Line 44, “molybdenium” should read -- molybdenum -- and “47,5248” should read -- 47,5248 --; and
Line 51, “32,646” should read -- 32,646 --.

Column 3,
Line 38, “important” should read -- it is important --;
Line 39, “is how” should be deleted; and
Line 63, “getter” should read -- the getter --.

Column 4,
Line 13, “getter” should read -- the getter --.

Column 5,
Line 43, “getter” should read -- the getter --.

Column 9,
Line 51, “maybe” should read -- may be --.

UNITED STATES PATENT AND TRADEMARK OFFICE

CERTIFICATE OF CORRECTION

PATENT NO. : 6,624,586 B2
DATED : September 23, 2003
INVENTOR(S) : Naoto Abe et al.

It is certified that error appears in the above-identified patent and that said Letters Patent is hereby corrected as shown below:

Column 10,
Line 43, “wring” should read -- wiring --.

Column 12,
Line 9, “=0.8 mA]” should read -- =0.8[mA] --;
Line 33, “determined to” should read -- determined to be --;
Line 34, “(Iemaxx Va)” should read -- (Iemax x Va) --; and
Line 65, “ relative” should read -- relatively --.

Signed and Sealed this

Twenty-fifth Day of May, 2004

JON W. DUDAS
*Acting Director of the United States Patent and Trademark Office*